United States Patent [19]

Gladwin

[11] Patent Number: 4,699,201

[45] Date of Patent: Oct. 13, 1987

[54] SIDE WALL MEMBERS FOR CONTINUOUS CASTING MOLDS

[75] Inventor: Kirk M. Gladwin, Grosse Ile, Mich.

[73] Assignee: Westinghouse Electric Corp., Pittsburgh, Pa.

[21] Appl. No.: 532,450

[22] Filed: Sep. 15, 1983

[51] Int. Cl.[4] ..... B22D 11/00

[52] U.S. Cl. ..... 164/436; 164/491

[58] Field of Search ..... 164/436, 491, 342; 249/82, 158, 157; 308/3 R

[56] References Cited

U.S. PATENT DOCUMENTS

| | | | |
|---|---|---|---|
| 1,207,071 | 12/1916 | Parsons | 308/3 R |
| 3,168,355 | 11/1966 | Rudolph | 308/3 R |
| 3,443,461 | 5/1969 | DeBiasse | 308/3 R |
| 3,794,105 | 2/1974 | Voss | 164/436 |
| 3,938,852 | 2/1976 | Hein et al. | 308/3 R |
| 3,964,727 | 6/1976 | Gladwin | 249/158 |
| 3,999,736 | 12/1978 | Theodorsen | 249/157 |
| 4,086,951 | 5/1978 | Takahasi et al. | 164/491 |
| 4,124,058 | 11/1978 | Gladwin | 164/436 |

FOREIGN PATENT DOCUMENTS

| | | | |
|---|---|---|---|
| 110581 | 4/1964 | Czechoslovakia | 308/3 R |
| 1495042 | 2/1975 | United Kingdom | 308/3 R |

OTHER PUBLICATIONS

"Woven-Teflon Bearings for High-Load Application", Power Transmission, vol. 31, No. 7, Jul. 1970.

Webster New International Dictionary; 2nd ed., unabridged, 1959.

*Primary Examiner*—Nicholas P. Godici

*Assistant Examiner*—G. Reid

*Attorney, Agent, or Firm*—B. R. Studebaker

[57] ABSTRACT

Improved side wall plate members for an adjustable width, continuous casting mold. The adjustable width continuous casting mold is formed of a pair of opposed, spaced apart front and rear mold wall members and a pair of opposed, spaced apart side wall members with the side wall members clamped between the front and rear mold wall members. The improved side wall members of the present invention prevent scratching and wearing of the surfaces of the adjacent front and rear mold walls during mold width adjustment and also prevent twisting or tilting of the mold wall side members during such adjustment. Furthermore, the improved side wall members avoid the formation of flash producing gaps or spaces at the corners of the mold. Each sidewall member according to the present invention, includes, along its side edges, i.e., the edges in contact with the adjacent front and rear mold wall members, a bearing surface formed of a low friction, thermally stable, compressible, memory material. The bearing surface is preferably an insert positioned in a socket or groove within the side edge of the side wall member. The bearing surfaces or inserts are compressed when the mold cavity is clamped together so that the side edges of the side wall members are in contact with the front and rear mold wall members. When it is desired to adjust the width of the mold cavity, the inserts expand beyond the side edges of the side walls into contact with the adjacent front and rear mold wall members.

7 Claims, 7 Drawing Figures

SIDE WALL MEMBERS FOR CONTINUOUS CASTING MOLDS

BACKGROUND OF THE INVENTION

The present invention relates generally to molds used for continuous casting of molten metal and, more particularly, to an improved side wall member for an adjustable width continuous casting mold. Molds of the type heretofore used in the continuous casting of molten metal slabs are described and illustrated in numerous prior art patents such as U.S. Pat. Nos. 3,964,727 of June 22, 1976, and 4,124,058 of Nov. 7, 1978. Typically, continuous casting molds comprise a pair of opposed, spaced apart side walls which are adjustably clamped between opposed, spaced apart front and rear walls. The four walls are configured as a box-like container or frame having open upper and lower ends to form a casting cavity interiorly of the walls. Molten metal is poured into the open upper end of the mold and is partially cooled within the cavity as the metal flows downwardly through the cavity under the influence of gravity so as to form a solidified skin surrounding an interior core of molten metal. This skin and core together form a continuous elongated extrusion-like slab which emerges from the open lower end of the mold and is thereafter cooled to form a solid slab.

As described in the aforementioned U.S. Pat. No. 3,964,727, the mold side walls (often referred to as side wall members) are supported upon mounting blocks so that they may be adjusted inwardly toward each other or outwardly away from each other by adjusting longitudinal movement of support shafts carried by the blocks. The mounting blocks also are provided with bolts to support the blocks to the front and rear walls of the mold, and plungers or separators to separate the mold walls against a spring pressure to thus loosen the side wall members for adjustment when desired. During adjustment of the widths of the conventional molds as described above, where the front and rear walls of the mold are held sufficiently apart to unclamp the side wall members so that the side wall members may be adjusted inwardly or outwardly to change the width of the metal slab, it has been found that the movement of the side wall members sometimes resulted in tilting or twisting of the side wall members out of vertical aligmment relative to the mold cavity. Furthermore, the movement of the side wall members often resulted, prior to the present invention, in scratching and wearing of the interior mold wall surfaces which was caused by face-to-face contact between the moving side wall plate members and the front and rear mold walls. This scratching and wearing often caused irregularities on the surface of the metal slab. In addition, the scratching and wearing of the interior mold wall·surfaces often produced gaps or spaced between the edges of the side wall members and the adjacent front or rear wall members. These gaps or spaces could result in the formation of flash along one or more corners of the slab. The scratches and the flash also caused the slab to resist smooth movement through the mold cavity and thus resulted in tearing, breaking or the formation of weak spots in the fragile, thin slab skin allowing the molten metal core to break out.

In addition, the scratching and wearing of the mold wall interior surfaces requires more frequent replacement of the mold wall surfaces resulting in greater downtime, i.e., time during which production must be halted so that the mold wall surfaces may be replaced.

Thus the invention herein relates to an improved side wall member for an adjustable width continuous casting mold which solves the foregoing problems.

SUMMARY OF THE INVENTION

The invention herein contemplates improved side wall members for an adjustable width continuous casting mold which facilitates mold width adjustment while minimizing, if not completely eliminating, scratching and wearing of the mold wall interior surfaces and cocking and twisting of the mold during mold width adjustment. Furthermore, the present invention contemplates such improved side wall members which permit mold width adjustment without the resulting flash producing gaps or spaces.

Specifically, according to the prior art, a side wall member for a continuous casting mold includes an interior face plate of copper or a copper-like material secured to an exterior steel backing plate. The present invention contemplates an improved bearing surface for the side edges of each side wall. Specifically the present invention contemplates the provision of an elongated recess along the side edge of each side wall interior face plate and a socket is formed in each recess. A low friction thermally stable insert is secured in each socket. The inserts provided bearing surfaces which are in face-to-face contact with the adjacent front and rear mold wall surfaces.

When the front and rear mold walls are clamped together, the inserts are compressed within the recesses. When the clamping forces are released for mold width adjustment, the inserts expand back to their normal position, because the low friction thermally stable material has a memory, and thus the inserts are in contact with the front and rear mold walls. This prevents face-to-face contact between the edges of the side wall members and the front and rear mold wall interior surfaces during mold wall adjustment. The contact between the inserts and the front and rear mold walls avoids scratching and wearing of the face plates and eliminates formation of corner flash caused by gaps or spaces formed at the regions where the side wall plates and the front and rear wall plates meet to form the corners of the casting cavity. In addition, face-to-face contact between the inserts and the front and rear mold wall interior surfaces aids in keeping the side wall members in proper vertical alignment relative to the mold cavity thus avoiding twisting or tilting of the side wall members.

After adjustment of the side wall members, the front and rear walls are reclamped toward each other and the inserts are compressed within the recesses thus permitting face-to-face contact between each side wall interior face plate and the adjacent front and rear interior face plate surfaces to eliminate flash producing gaps or spaces during the casting operation.

BRIEF DESCRIPTION OF THE DRAWINGS

The various objects, benefits and advantages of the present invention will become more apparent upon reading the following detailed description of the invention taken in conjunction with the drawings. In the drawings, wherein like reference numerals identify corresponding components.

DETAILED DESCRIPTION

Figure 1:
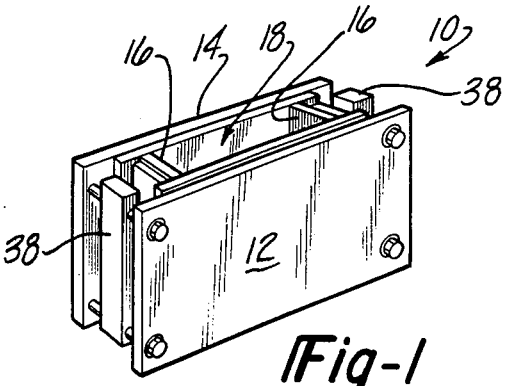
FIG. 1 is a perspective view of a continuous casting mold according to the principles of the present invention.
Figure 2:
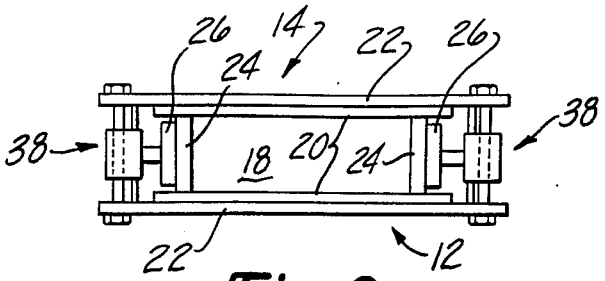
FIG. 2 is a plan view of the continuous casting mold of FIG. 1.
Figure 3:
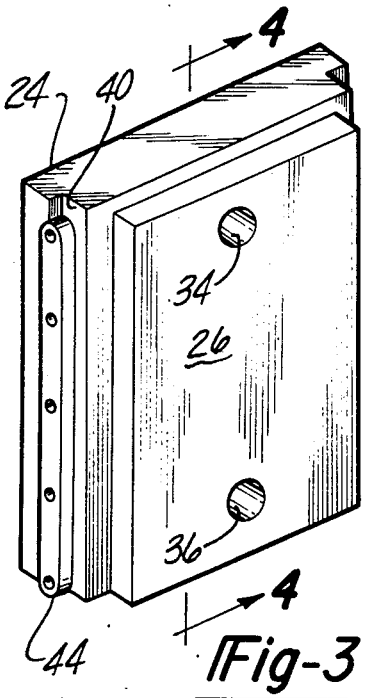
FIG. 3 is an enlarged perspective view of the improved side wall member of the present invention.
Figure 4:
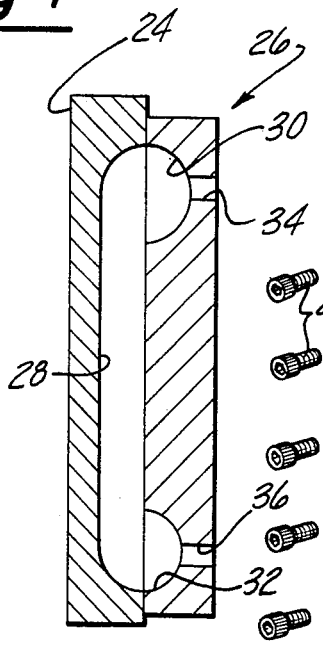
FIG. 4 is a cross-sectional view of the improved side wall member of the present invention taken in the direction of arrows 4—4 of FIG. 3.
Figure 5:
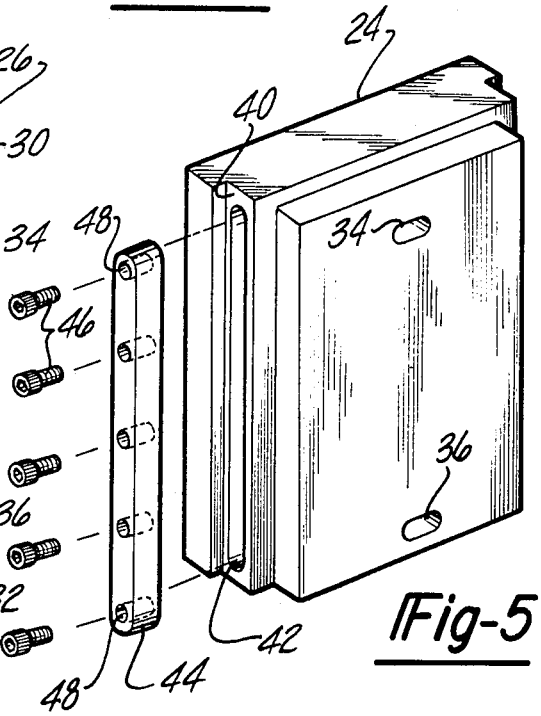
FIG. 5 is an exploded perspective view of the improved side wall member of the present invention.
Figure 6:
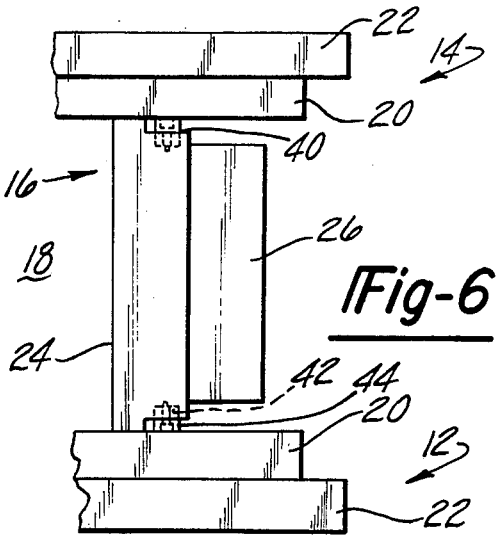
FIG. 6 is an enlarged fragmentary plan view of the continuous casting mold and improved side wall member of the present invention when the front and rear walls have the clamping forces released.
Figure 7:
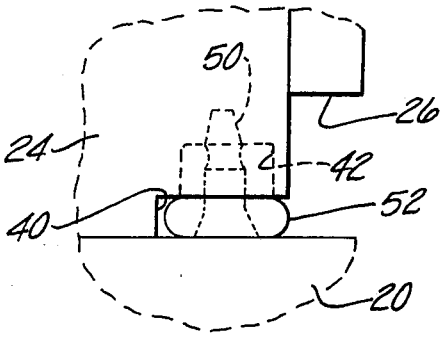
FIG. 7 is an enlarged fragmentary plan view of the continuous casting mold improved side wall when the front and rear walls are clamped toward each other.

The continuous casting mold of the present invention is similar to the continuous casting mold described and illustrated in U.S. Pat. Nos. 3,964,727 of June 22, 1976 and 4,124,058 of Nov. 7, 1978, the disclosures of which patents are hereby incorporated by reference. The continuous casting mold-10 comprises opposed, spaced apart front and rear walls 12, 14, respectively and a pair of opposed, spaced apart improved side wall members 16 of the present invention. The four walls are configured as a rectangular box-like container open at the top and bottom and the side walls 16 are clamped between the front and rear walls 12 and 14 to define a casting cavity 18 therebetween which is approximately rectangular in cross-section. Molten metal is poured into the open upper end of the cavity 18 and solidified metal in the form of a rectangular shaped slab having a solidified skin enclosing a molten metal core emerges from the open lower end of the mold cavity.

The front and rear mold walls 12, 14, respectively, are each formed as a laminate structure including a copper or copper-like face plate 20 mounted upon a steel jacket or steel backing plate 22.

Each of the side wall members 16 is also a laminate structure formed of an interior copper or copper-like face plate 24 secured to a steel jacket or steel backing plate 26. Since the copper face plates face the mold cavity 18, the copper face plates are often referred to as the interior face plates of the mold and the steel jackets or backing plates are often referred to as the exterior mold plates. Each of the interior face plates is secured to its respective steel jacket or backing plate in a conventional manner as described in the aforementioned patents.

Cooling means is provided between each interior face plate and its respective backing plate for cooling the face plate and extracting heat from the metal being cast thus facilitating formation of the solidified metal skin while the molten metal is within the casting cavity. A conventional cooling means is disclosed in U.S. Pat. No. 3,978,910 of Sept. 7, 1976 which is hereby incorporated by reference. In general terms, each of the interior face plates is provided with a series of parallel, vertically arranged, spaced-apart groove-like channels 28 and each of the steel jackets or backing plates is provided with horizontally arranged upper and lower pockets or depressions 30, 32, respectively, which act as headers. Conduits 34, 36, extending through each of the steel jackets permit entry of a cooling fluid medium such as water into the lower header 32, through the channels or grooves 28, through the upper header 30 and thereafter out of the side wall member. In actual practice the same type of cooling structure is provided for each of the four mold walls.

It is conventional, with adjustable width continuous casting molds, to provide releasable means 38 to clamp the side wall members between the opposed front and rear wall members. The releasable clamping means 38 also includes means for controlling the movement of the side wall members 16 toward and away from each other to decrease or increase, respectively, the width of the continuous casting cavity. Suitable clamping and adjusting means are disclosed in the aforementioned United States Patents. To insure proper contact between each copper face plate 20, 24 of each of the four mold walls when the mold walls are clamped together, the copper face plates 20, 24 are typically of a slightly greater width than their respective backing plates or steel jackets.

As heretofore described, when it is desired to adjust the width of the continuous casting mold cavity, the clamping means 38 is actuated to release the clamping force on the side wall members and the side wall members are thereafter moved toward or away from each other. If the clamping force is not completely released there may be scratching or damage to the interior face plate 20 of the front and rear mold walls. During releasing of the clamping force if some minimal clamping force is not maintained, then during adjustment of the side walls there may be twisting or tilting of the side wall members out of vertical alignment, i.e., the face plates 24 of the side wall members may not retain their desired parallelism relative to the vertical axis of the casting cavity.

The present invention overcomes these problems by the provision of an improved, low friction bearing surface on the side edge of each of the side wall plate members.

According to the principles of the present invention, each side edge of each side wall member 16 is provided with an elongated recess 40 extending the entire length of each side wall edge. The recess 40 is formed in the face plate 24 adjacent the junction of the face plate to its respective steel backing plate.

An elongated groove or socket 42 is machined within the recess. The socket 42 is narrower than the recess and extends substantially the entire vertical length of the recess.

According to the principles of the present invention, a resilient thermally stable, low friction insert 44 is secured within each socket 42 such as by machine screws 46. The machine screws 46 extend through screw holes 48 in the insert and into holes 50 in the socket 42. In addition, the insert 44 may be fastened within the socket 42 by a suitable glue. The inserts 44 are preferably made of a thermally stable material having a low coefficient of friction and capable of withstanding the heat normally encountered during continuous casting of molten metal. A suitable commercially available material is polytetrafluoroethylene such as the DuPont brand Teflon which has a maximum continuous use temperature of about 550° F. Such material may be resiliently compressed upon clamping the side walls between the front and rear walls, as will hereafter be described, and yet has sufficient memory to return to its normal configuration when the clamping force is removed.

When the insert 44 is secured within its socket and the mold is clamped together, the portion of the insert which is exterior to the socket is compressed and forms a bulbous portion 52. The side edges of the face plate 24 of the side wall member is in contact with the face plate 20 of the front and rear mold wall members to avoid gap producing spaces at the corners of the mold cavity.

When the front and rear mold walls are released via the clamping means 38 to permit adjustment of the width of the continuous casting mold, the bulbous portion 52 of the insert returns to its normal configuration, because of the inherent memory of the polytetrafluoroethylene material, and extends outwardly beyond the side edge of the side wall copper face plate 24 thus maintaining contact between the low friction insert 44 and the front and rear mold wall members. Thus with the front and rear walls unclamped, the low friction inserts 44 are in face-to-face contact with the face plates 20 of the front and rear walls rather than the edge of the side wall copper face plate 24 itself being in contact with the front and rear face plates. Thus during the width adjustment of the mold side wall members, the side wall members slide more easily, since the inserts form bearing surfaces, thus preventing scratching or wearing of the copper face plates 20 of the front and rear walls 12, 14. In addition, the face to face contact between the inserts 44 and the face plates 20 of the front and rear mold walls 12, 14 during such adjustment assists in maintaining the vertical alignment of the side wall members during adjustment avoiding twisting or tilting of the side wall members during such adjustment relative to the vertical axis of the casting cavity.

Thereafter when the mold width adjustment is completed, the clamping means 38 is actuated to again clamp the side wall members 16 between the front and rear mold wall members 12, 14 respectively, which again compresses each of the inserts 44 forming the bulbous portion 52 on each of the inserts. This again allows direct face-to-face contact between the face plates 20 of the front and rear walls and the face plates 24 of the side walls thus avoiding the formation of flash producing gaps or spaces at the intersection of each side wall and its adjacent front or rear wall.

As indicated previously, the polytetrafluoroethylene has a continuous maximum use temperature recommended by the manufacturer of 550° F. To aid in maintaining each insert at or below this temperature, it is desirable to position each insert as far away as feasible from the casting surface of its respective face plate and as close as possible to the cooling means. For this reason it will be noted that each of the recesses 40 and the sockets 42 and thus the inserts 44 are positioned remote from the interior facing of each face plate and are positioned as close as feasible to the junction of each face plate with its respective steel jacket.

The foregoing is a complete description of a preferred embodiment of the present invention. Various changes may be made without departing from the spirit and scope of the present invention. The invention, therefore, should be limited only by the following claims.

What is claimed is:

1. In an adjustable width continuous casting mold formed of a pair of opposed, spaced apart front and rear mold wall members and a pair of opposed, spaced apart side wall members, with the side wall members arranged between the front and rear wall mold members to form a roughly rectangular in cross-section open upper and lower ended casting cavity, and with each of said side wall members having a pair of opposed side edges, the first side edge of the pair of edges being defined as that portion of the side wall member in contact with the adjacent front mold wall member and the other side being defined as that portion of the side wall member in contact with the adjacent rear mold wall member, the improvement comprising:

a recess formed in each side edge extending from a midportion to an end of the side edge, said recess thus forms a stepped side edge with a recessed surface for providing a clearance between a portion of each side edge and the adjacent mold wall member; and a low friction bearing member formed on each of said side edges and positioned on the recess surface of each side edge each insert extending beyond the side edge of the side wall for sliding contact with the adjacent front and rear mold wall members when the clamping forces are partially released so that the width of the casting cavity may be adjusted.

2. The invention as defined in claim 1 including:

a socket formed in each recess of said side edges of at least one of said side wall members; and said insert of low friction material positioned in said socket and extending outwardly of said socket to provide said low friction bearing surface in contact with the front and rear mold wall members.

3. In an adjustable width continuous casting mold formed of a pair of opposed, spaced apart front and rear mold wall members each having interior casting surfaces and a pair of opposed, spaced apart side wall members each having interior casting surfaces with the side wall members being arranged between the front and rear mold wall members to form a roughly rectangular in cross-section upper and lower ended casting cavity, with the side wall members each being formed of an interior face plate and an exterior backing plate and with each interior face plate having opposed side edges, the side edges being defined as the portions of the side wall members in contact with its adjacent respective front and rear mold wall, and means for releasably clamping the side wall members between the front and rear mold wall members and for adjusting the side wall members toward and away from each other for thereby adjusting the width of the casting cavity, the improvement comprising:

a recess extending along the length of each of said edges of each of said side walls;

a socket formed in each of said recesses; and a low friction, thermally stable insert positioned in each socket;

each insert having a portion thereof in face-to-face contact with the interior surface of the adjacent front and rear mold wall;

each insert extending beyond the side edge of the side wall for sliding contact with the adjacent front and rear mold wall members when the clamping forces are partially released so that the width of the casting cavity may be adjusted.

4. The invention as defined in claim 3 wherein each insert is formed of a compressible material having a memory, the insert being compressed during the application of clamping forces to the mold so that the front and rear mold walls are in contact with the edges of the side walls;

the insert memory for causing the insert to expand beyond the side edge of the side wall member into contact with the adjacent mold wall interior surface during adjustment of the width of the mold cavity.

5. The invention as defined in claim 3 wherein each insert extends substantially the entire length of the side edge of the side wall member for maintaining the side wall member in proper vertical alignment relative to the adjacent mold wall members during mold width cavity adjustment.

6. The invention as defined in claim 3 wherein said recesses are formed on the side edge of each side wall member remote from the side wall member interior surface for assisting in cooling said insert by keeping said insert remote from the casting cavity itself.

7. The invention as defined in claim 3 wherein said low friction insert is formed of polytetrafluoroethylene.

* * * * *